US011591674B2

(12) United States Patent
Kuramoto et al.

(10) Patent No.: US 11,591,674 B2
(45) Date of Patent: Feb. 28, 2023

(54) ALUMINUM-ALLOY SHEET

(71) Applicants: UACJ Corporation, Tokyo (JP); TOYOTA JIDOSHA KABUSHIKI KAISHA, Toyota (JP)

(72) Inventors: Ryo Kuramoto, Aichi (JP); Takeshi Nagai, Aichi (JP); Yuya Masuda, Toyota (JP); Kazutaka Ohno, Toyota (JP)

(73) Assignees: UACJ CORPORATION, Tokyo (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 57 days.

(21) Appl. No.: 17/065,995

(22) Filed: Oct. 8, 2020

(65) Prior Publication Data

US 2021/0108293 A1 Apr. 15, 2021

(30) Foreign Application Priority Data

Oct. 9, 2019 (JP) ..... JP2019-186193

(51) Int. Cl.

| | |
|---|---|
| ***C22C 21/04*** | (2006.01) |
| ***C22F 1/043*** | (2006.01) |
| ***C21D 8/02*** | (2006.01) |
| ***C21D 9/46*** | (2006.01) |

(52) U.S. Cl.

CPC ..... *C22C 21/04* (2013.01); *C21D 8/0226* (2013.01); *C21D 8/0236* (2013.01); *C21D 9/46* (2013.01); *C22F 1/043* (2013.01)

(58) Field of Classification Search

CPC ..... C22C 21/04; C22C 21/02; C22C 1/026; C21D 8/0226; C21D 8/0236; C21D 9/46; C22F 1/043

USPC ..... 148/439

See application file for complete search history.

(56) References Cited

U.S. PATENT DOCUMENTS

| | | | |
|---|---|---|---|
| 6,355,090 | B1 | 3/2002 | Koji et al. |
| 8,317,947 | B2 | 11/2012 | Asano et al. |
| 10,661,389 | B2 | 5/2020 | Masse et al. |
| 2003/0005984 | A1 | 1/2003 | Koji et al. |
| 2004/0187985 | A1 | 9/2004 | Matsumoto et al. |
| 2010/0183899 | A1 | 7/2010 | Asano et al. |
| 2018/0119261 | A1 | 5/2018 | Das et al. |
| 2018/0185962 | A1 | 7/2018 | Masse et al. |
| 2019/0153576 | A1* | 5/2019 | Kurosaki ..... C22C 21/04 |
| 2021/0025663 | A1 | 1/2021 | Oya et al. |

FOREIGN PATENT DOCUMENTS

| | | | |
|---|---|---|---|
| CN | 1410572 | A | 4/2003 |
| CN | 101539064 | A | 9/2009 |
| CN | 102876934 | A | 1/2013 |
| CN | 103484729 | A | 1/2014 |
| CN | 106521258 | A | 3/2017 |
| CN | 106591616 | A | 4/2017 |
| CN | 107708917 | A | 2/2018 |
| CN | 108425045 | A | 8/2018 |
| CN | 109890535 | A | 6/2019 |
| CN | 110129630 | A | 8/2019 |
| CN | 111936646 | A | 11/2020 |
| JP | H09256095 | A | 9/1997 |
| JP | H11293363 | A | 10/1999 |
| JP | 2000313931 | A | 11/2000 |
| JP | 2003034835 | A | 2/2003 |
| JP | 2003073764 | A | 3/2003 |
| JP | 2017031471 | A | 2/2017 |
| JP | 2019094517 | A | 6/2019 |

OTHER PUBLICATIONS

Office Action and Search Report from the Chinese Patent Office dated Sep. 1, 2021, in related Chinese application No. 202011071593.2, and machine translation thereof.

Decision to Grant Patent dated Mar. 17, 2021, in related JP application No. 2019-186193.

Office Action from the Chinese Patent Office dated Jan. 10, 2022 in counterpart Chinese Patent Application No. 202011071593.2, and machine translation thereof.

* cited by examiner

*Primary Examiner* — Brian D Walck
*Assistant Examiner* — Danielle M. Carda
(74) *Attorney, Agent, or Firm* — J-Tek Law PLLC; Jeffrey D. Tekanic; Scott T. Wakeman

(57) ABSTRACT

An aluminum-alloy sheet has a chemical composition containing Si: 2.3-3.8 mass %, Mn: 0.35-1.05 mass %, Mg: 0.35-0.65 mass %, Fe: 0.01-0.45 mass %, and at least one element selected from the group consisting of Cu: 0.0010-1.0 mass %, Cr: 0.0010-0.10 mass %, Zn: 0.0010-0.50 mass %, and Ti: 0.0050-0.20 mass %. The ratio of the Si content to the Mn content is 2.5 or more and 9.0 or less. The aluminum-alloy sheet exhibits an elongation of 23% or more and a strain hardening exponent of 0.28 or more at a nominal strain of 3%. Such an aluminum-alloy sheet is well suited for press forming (stamping) applications, such as forming automobile body panels.

24 Claims, No Drawings

ALUMINUM-ALLOY SHEET

CROSS-REFERENCE

The present application claims priority to Japanese patent application serial number 2019-186193 filed on Oct. 9, 2019, the contents of which are incorporated fully herein by reference.

TECHNICAL FIELD

The present invention generally relates to aluminum-alloy sheets, e.g., for use in the manufacture of automobile body panels, etc.

BACKGROUND ART

Although the specific gravity (relative density) of Mg-containing aluminum alloys, such as Al—Mg (aluminum-magnesium) alloys, Al—Mg—Si (aluminum-magnesium-silicon) alloys, and Al—Mg—Si—Cu (aluminum-magnesium-silicon-copper) alloys, is approximately one-third of cold-rolled steel sheets, the strength of such aluminum-alloy sheets is equivalent to cold-rolled steel sheets. In addition, the strength of Al—Mg—Si alloys and Al—Mg—Si—Cu alloys increases owing to bake hardenability, i.e. heating at the time of painting, baking, etc. Taking advantage of these properties, the replacement of cold-rolled steel sheets with Mg-containing aluminum-alloy sheets continues to progress in fields in which there is strong demand for weight reduction, such as automobile body sheets, body panels, and the like.

To prepare such types of aluminum-alloy sheets, aluminum metal having an aluminum purity of 99.9% or more has typically been used in the past as the source of aluminum for the casting material. However, if the content of such substantially pure aluminum metal in the casting material is high, materials costs tend to be high too.

To address this problem, techniques have been proposed to use aluminum automobile scrap as at least a portion of the casting material. For example, Japanese Laid-open Patent Publication 2000-313931 discloses an automobile aluminum-sheet material having an aluminum alloy composition containing, as essential elements, Si (silicon): greater than 2.6 wt % and 5 wt % or less, Mg (magnesium): 0.2-1.5 wt %, Zn (zinc): 0.2-1.5 wt %, Cu (copper): 0.2-1.5 wt %, Fe (iron): 0.2-1.5 wt %, and Mn (manganese): 0.05 or more and less than 0.6 wt %, and further containing one or two or more elements selected from the group consisting of Cr (chrome): 0.01-0.2 wt %, Ti (titanium): 0.01-0.2 wt %, Zr (zirconium): 0.01-0.2 wt %, and V (vanadium): 0.01-0.2 wt %, the remainder being composed of aluminum and unavoidable impurities.

SUMMARY OF THE INVENTION

However, when the automobile aluminum-sheet material disclosed in JP 2000-313931 is subjected to press forming (stamping) to form the shape of the final product (e.g., an automobile body panel), the amount of increase in the strength of the automobile aluminum-sheet material generated by work hardening (strain hardening) during press forming is relatively small. Therefore, it is difficult to manufacture a final product having sufficient strength for the application.

To increase the strength of the final product, it is conceivable to further increase the strength of the automobile aluminum-sheet material prior to press forming.

However, as the strength of the aluminum-sheet material increases, its elongation (elongation at break or elongation at ultimate failure) tends to decrease, which may cause a degradation in press formability (plastic deformability). This may lead to the formation (generation) of wrinkles or creases in the final product during the press forming. Accordingly, there is a demand for an aluminum-sheet material in which the amount of increase in strength generated by work hardening is relatively large in order to manufacture, e.g., high-strength, wrinkle-free shaped products.

It is therefore one non-limiting object of the present teachings to provide techniques for preparing aluminum-alloy sheets (materials) with lower materials cost while being capable of relatively large strength increases generated by work hardening (strain hardening) during press forming (stamping).

In one aspect of the present teachings, an aluminum-alloy sheet has a chemical composition containing Si (silicon): 2.3 mass % or more and 3.8 mass % or less, Mn (manganese): 0.35 mass % or more and 1.05 mass % or less, Mg (magnesium): 0.35 mass % or more and 0.65 mass % or less, and Fe (iron): 0.01 mass % or more and 0.45 mass % or less, further containing one or two or more elements selected from the group consisting of Cu (copper): 0.0010 mass % or more and 1.0 mass % or less, Cr (chromium): 0.0010 mass % or more and 0.10 mass % or less, Zn (zinc): 0.0010 mass % or more and 0.50 mass % or less, and Ti (titanium): 0.0050 mass % or more and 0.20 mass % or less. The remainder may be composed of Al (aluminum) and unavoidable impurities and possibly optional additional elements. The mass ratio of Si/Mn, i.e., the ratio of the Si content to the Mn content, is 2.5 or more and 9.0 or less.

The elongation (elongation at break or elongation at ultimate failure) of the aluminum-alloy sheet preferably is 23% or more and its strain hardening exponent (strain hardening index) at the time a nominal strain of 3% has been introduced preferably is 0.28 or more.

By setting the Si content, the Mn content, the Fe content, etc. of the chemical composition of the aluminum-alloy sheet within the above-mentioned specific ranges, advantageous aluminum-alloys sheets can be manufactured from casting materials (raw materials) containing a high percentage of aluminum scrap, even if the entire source of aluminum in the casting material is aluminum scrap. For this reason, the materials cost of such above-mentioned aluminum-alloy sheets can be reduced without difficulty.

In addition, in aluminum-alloy sheets according to the present teachings, the mass ratio Si/Mn (i.e., the ratio of the Si content to the Mn content) is preferably within the above-mentioned specific range. In this case, the amount of increase in strength generated by work hardening (strain hardening) can be made relatively large without adversely impacting various other properties such as strength, bake hardenability, etc.

Furthermore, aluminum-alloy sheets according to the present teachings are capable of achieving a strain hardening exponent of 0.28 or more at the time a nominal strain of 3% has been introduced. Therefore, such aluminum-alloy sheets are capable of generating a relatively large increase in strength upon being work hardened (strain hardened), even if the plastic working (plastic deformation), such as press forming (stamping), introduces only a relatively small amount of strain.

Therefore, aluminum-alloy sheets according to the present teachings can be prepared with a relatively low materials cost while still achieving relatively large strength increases during work hardening.

DETAILED DESCRIPTION OF EMBODIMENTS ACCORDING TO THE INVENTION

Aluminum-Alloy Sheets

Aluminum-alloy sheets according to the present teachings contain Si, Mn, Mg, and Fe as essential components. Furthermore, in addition to these essential components, aluminum-alloy sheets according to the present teachings contain one, two, three or four elements selected from the group consisting of Cu, Cr, Zn, and Ti. Aluminum-alloy sheets according to the present teachings optionally may further contain Ni (nickel). The ranges of the chemical composition of aluminum-alloy sheets according to the present teachings and reasons for limiting these ranges are explained in detail below.

Si: 2.3 Mass % or More and 3.8 Mass % or Less

Aluminum-alloy sheets according to the present teachings contain Si: 2.3 mass % or more and 3.8 mass % or less as an essential component. A portion of this silicon exists in the aluminum-alloy sheet as Si solute that has formed a solid solution in the Al matrix. In addition, it is noted that Si not in solid solution in the Al matrix typically exists in forms such as elemental Si, $Mg_2Si$, Al—(Fe, Mn)—Si intermetallic compounds, Al—Mn—Si intermetallic compounds, Al—Fe—Si intermetallic compounds, or the like.

By setting the Si content in the aluminum-alloy sheet within the above-mentioned specific range, the amount of Si in solid solution in the Al matrix can be made relatively large. As a result, even if the plastic working (deformation) introduces a relatively small amount of strain, the amount of increase in strength generated by the work hardening (strain hardening) can be made relatively large. To further increase the amount of increase in strength generated by work hardening, the Si content is preferably set to 2.4 mass % or more. In addition or in the alternative, from the same viewpoint, the Si content is preferably set to 3.6 mass % or less.

If the Si content is less than 2.3 mass %, Si in the aluminum-alloy sheet tends to be consumed by the formation of Al—Mn—Si intermetallic compounds, Al—Fe—Si intermetallic compounds, or the like. Consequently, in this case, there is a risk that the amount of Si in solid solution will be insufficient, leading to a reduction in the amount of increase in strength generated by work hardening.

If the Si content exceeds 3.8 mass %, the amount of elemental Si becomes great, and consequently there is a risk that it will lead to a decrease in elongation (i.e. elongation at break or elongation at ultimate failure). In addition, in this case, Mn in the aluminum-alloy sheet tends to be consumed by the formation of Al—Mn—Si intermetallic compounds, or the like. Consequently, in this case, there is a risk that the amount of Mn in solid solution will be insufficient, leading to a reduction in the amount of increase in strength generated by work hardening.

Mn:0.35 Mass % or More and 1.05 Mass % or Less

Aluminum-alloy sheets according to the present teachings contain Mn: 0.35 mass % or more and 1.05 mass % or less as an essential component. A portion of this manganese exists in the aluminum-alloy sheet as Mn solute that has formed a solid solution in the Al matrix. In addition, Mn that is not in solid solution in the Al matrix exists in the forms of Al—(Fe, Mn)—Si intermetallic compounds, Al—Mn—Si intermetallic compounds, or the like.

By setting the Mn content in the aluminum-alloy sheet within the above-mentioned specific range, the amount of Mn in solid solution in the Al matrix can be made relatively large. As a result, even if the plastic working (deformation) introduces a relatively small amount of strain, the amount of increase in strength generated by work hardening can still be made relatively large. To further increase the amount of increase in strength generated by work hardening, the Mn content is preferably set to 0.40 mass % or more.

If the Mn content is less than 0.35 mass %, Mn in the aluminum-alloy sheet tends to be consumed by the formation of Al—Mn—Si intermetallic compounds, or the like. Consequently, in this case, there is a risk that the amount of Mn in solid solution will be insufficient, leading to a reduction in the amount of increase in strength generated by work hardening.

If the Mn content exceeds 1.05 mass %, there is a risk that the amount of Mn in solid solution will become excessively large. Consequently, in this case, owing to the excessive increase in the strength of the aluminum-alloy sheet prior to press forming, there is a risk that wrinkles will tend to be created in the final product (shaped product) during press forming. In addition, in this case, owing to an excessive decrease in elongation, there is a risk that it will lead to degradation of press formability (plastic deformability). To further increase the amount of increase in strength generated by work hardening while more reliably avoiding these problems, the Mn content is preferably set to 1.0 mass % or less and more preferably set to 0.80 mass % or less.

Si/Mn Ratio: 2.5 or More and 9.0 or Less

In aluminum-alloy sheets of the present teachings, the value of the Si/Mn mass ratio of the Si content to the Mn content is 2.5 or more and 9.0 or less. By not only setting the Si content and the Mn content within their respective specific ranges but also setting the Si/Mn mass ratio value within its specific range, the amount of Al—Mn—Si intermetallic compounds formed in the aluminum-alloy sheet can be reduced. As a result, the amounts of Si and Mn in solid solution in the Al matrix can be made relatively large. Therefore, even if the plastic working (deformation) introduces a relatively small amount of strain, the amount of increase in strength generated by work hardening can still be made relatively large. To further increase such effects, the Si/Mn value is preferably 3.0 or more and more preferably 3.2 or more. In addition or in the alternative, from the same viewpoint, the Si/Mn value is preferably 8.0 or less and more preferably 7.0 or less.

Mg: 0.35 Mass % or More and 0.65 Mass % or Less

Aluminum-alloy sheets according to the present teachings contain Mg: 0.35 mass % or more and 0.65 mass % or less as an essential component. Mg exists in the aluminum-alloy sheet in the form of $Mg_2Si$ or the like.

By setting the Mg content in the aluminum-alloy sheet within the above-mentioned specific range, the amount of $Mg_2Si$ in the aluminum-alloy sheet can be made relatively large. As a result, the strength of the aluminum-alloy sheet can be made high by precipitation strengthening. To further increase the strength of the aluminum-alloy sheet, the Mg content is preferably set to 0.40 mass % or more.

If the Mg content is less than 0.35 mass %, because the number of GP zones created will become small, the strength-improving effect generated by precipitation strengthening will tend to become small. Consequently, in this case, there is a risk that it will lead to a decrease in the strength of the aluminum-alloy sheet.

If the Mg content exceeds 0.65 mass %, coarse Mg—Si-based intermetallic compounds tend to be formed in the aluminum-alloy sheet, and there is a risk that this will lead to a decrease in elongation and to degradation in press formability. To increase the strength of the aluminum-alloy sheet while more reliably avoiding these problems, the Mg content is preferably set to 0.60 mass % or less.

Fe: 0.010 Mass % or More and 0.45 Mass % or Less

Fe is an element that is typically included (present) in casting materials (raw materials, such as aluminum scrap) and is present in the aluminum-alloy sheets of the present teachings in the form of Al—Fe—Si intermetallic compounds, Al—(Fe, Mn)—Si intermetallic compounds, or the like.

If aluminum scrap is used as the source of aluminum for the casting material, the Fe content in the aluminum alloy may be relatively high. However, if the Fe content in the aluminum-alloy sheet is too high, then the amounts of Al—Fe—Si intermetallic compounds and Al—(Fe, Mn)—Si intermetallic compounds formed in the aluminum-alloy sheet will tend to become large. Furthermore, if these intermetallic compounds are formed excessively, then there is a risk that the elongation of the aluminum-alloy sheet will become small, leading to degradation in press formability. In addition, if Al—Fe—Si intermetallic compounds or the like are formed, Si and Mn will be consumed, and consequently the amounts of Si and Mn in solid solution in the Al matrix will tend to become insufficient. As a result, there is a risk that this will lead to a reduction in the amount of increase in strength generated by work hardening.

Accordingly, to reduce the formation of intermetallic compounds and increase the amounts of Si and Mn in solid solution in the Al matrix, the Fe content is set to 0.45 mass % or less. From the same viewpoint, the Fe content is preferably 0.40 mass % or less and more preferably 0.35 mass % or less.

On the other hand, by setting the Fe content in the aluminum-alloy sheet to 0.010 mass % or more, a relatively high percentage of aluminum scrap may be used to prepare the casting material, thereby reducing the materials cost of the aluminum-alloy sheet without difficulty. If the Fe content in the aluminum-alloy sheet is less than 0.010 mass %, it is necessary to provide a relatively high ratio of pure aluminum metal in the casting material, and consequently the materials cost will tend to increase.

Cu: 0.0010 Mass % or More and 1.0 Mass % or Less

Aluminum-alloy sheets according to the present teachings may contain Cu: 0.0010 mass % or more and 1.0 mass % or less. By adding 0.0010 mass % or more of Cu to the aluminum-alloy sheet, the strength can be made even higher and press formability can be further improved.

On the other hand, if the Cu content becomes excessively high, then there is a risk that it will lead to a decrease in corrosion resistance. By setting the Cu content to 1.0 mass % or less, the effects described above can be exhibited while avoiding a decrease in corrosion resistance.

The Cu content in the aluminum-alloy sheet is preferably 0.35 mass % or less, more preferably less than 0.20 mass %, and yet more preferably 0.19 mass % or less. In this case, the corrosion resistance of the aluminum-alloy sheet can be further increased.

Cr: 0.0010 Mass % or More and 0.10 Mass % or Less

Aluminum-alloy sheets according to the present teachings may include Cr: 0.0010 mass % or more and 0.10 mass % or less. By adding 0.0010 mass % or more of Cr to the aluminum-alloy sheet, effects such as increased strength, increased fineness of the crystal grains, and improved surface treatability can be achieved.

On the other hand, if the Cr content becomes excessively high, then there is a risk that coarse intermetallic compounds will tend to be formed in the aluminum-alloy sheet, leading to degradation in press formability. By setting the Cr content to 0.1 mass % or less, the effects described above can be achieved while degradation in press formability is avoided.

Zn: 0.0010 Mass % or More and 0.50 Mass % or Less

Aluminum-alloy sheets according to the present teachings may include Zn: 0.0010 mass % or more and 0.50 mass % or less. By adding 0.0010 mass % or more of Zn to the aluminum-alloy sheet, effects such as increased strength, increased fineness of the crystal grains, and improved surface treatability can be achieved.

On the other hand, if the Zn content becomes excessively high, then there is a risk that it will lead to a decrease in corrosion resistance. By setting the Zn content to 0.50 mass % or less, the effects described above can be achieved while a decrease in corrosion resistance is avoided.

Ti: 0.0050 Mass % or More and 0.20 Mass % or Less

Aluminum-alloy sheets according to the present teachings may include Ti: 0.0050 mass % or more and 0.20 mass % or less. By setting the Ti content to 0.0050 mass % or more, the ingot microstructure can be made finer, the generation of cracks during casting can be reduced, and rollability during hot rolling can be improved.

On the other hand, if the Ti content becomes excessively high, then there is a risk that coarse crystallized products will tend to be formed in the aluminum material, leading to degradation in rollability and press formability. By setting the Ti content to 0.20 mass % or less, the formation of coarse crystallized products can be reduced, and the effects described above can be achieved.

If Ti is added to the aluminum-alloy sheet, it is more preferable to add 500 ppm by mass or less of B (boron) together with the Ti. In this case, the effect of making the ingot microstructure finer can be further increased, and the formation of abnormal (undesirable) crystal grains, such as columnar crystals, can be reduced.

Ni (nickel): 0.0050 Mass % or More and 0.15 Mass % or Less

Aluminum-alloy sheets according to the present teachings may include Ni: 0.0050 mass % or more and 0.15 mass % or less. Ni forms a solid solution in the Al matrix of the aluminum-alloy sheet. By setting the Ni content within the above-mentioned specific range, the amount of increase in strength generated by work hardening can be further increased, and corrosion resistance of the aluminum-alloy sheet can be further increased.

In addition, the Ni content is more preferably 0.010 mass % or more and 0.10 mass % or less, and more preferably 0.010 mass % or more and 0.08 mass % or less. In this case, the amount of increase in strength generated by work hardening can be further increased, and corrosion resistance of the aluminum-alloy sheet can be further increased.

Other Elements

In addition to the elements described above, aluminum-alloy sheets according to the present teachings may further contain Zr (zirconium): less than 0.050 mass % and/or Bi (bismuth): less than 0.050 mass %. The Bi content in the aluminum-alloy sheet is preferably less than 0.0050 mass %. In this case, corrosion resistance can be further increased.

Work-Hardening Property

Aluminum-alloy sheets according to the present teachings exhibit a strain hardening exponent (strain hardening index) of 0.28 or more at the time a nominal strain of 3% has been introduced, i.e. at a nominal strain of 3%. Thereby, even when plastic working (plastic deformation), such as press forming (stamping), that introduces a relatively small amount of strain is performed on the aluminum-alloy sheet, the amount of increase of the strength generated by the work hardening in the final product can be made relatively large. Consequently, such aluminum-alloy sheets possess properties suitable for press forming in that, prior to press forming, the aluminum-alloy sheets have a relatively low strength and excellent plastic deformability, but the strength thereof suitably increases after press forming.

The strain hardening exponent (also known as strain-hardening coefficient or strain hardening index) n is expressed as the exponent of true strain (applied strain) c in equation (1) below, which is known in the field as "Hollomon's equation". It is noted that symbol σ [MPa] in equation (1) below represents true stress (applied stress), and symbol C [MPa] (which is sometimes alternatively expressed as "K" in Hollomon's equation) represents the strength coefficient (strength constant).

$$\sigma=C\varepsilon^{n} \tag{1}$$

That is, the strain hardening exponent n is an exponent that indicates the extent of increase in strength generated by work hardening (strain hardening) for a given applied strain, which means that the larger the value of the strain hardening exponent n, the larger the amount of increase in strength caused by the applied strain.

If the strain hardening exponent n is less than 0.28, then the amount of increase in strength after plastic working will be relatively small, and consequently there is a risk that the aluminum-alloy sheet (i.e. the final product) after plastic working will have insufficient strength for a particular application.

Herein, the strain hardening exponent n is calculated using the method stipulated in JIS Z 2253:2011. That is, first, the rolling direction and the longitudinal direction of the aluminum-alloy sheet are set parallel, and test pieces having the shape stipulated in JIS Z 2241:2011 are taken (cut, extracted). Next, a tension test is performed on each test piece in accordance with the method stipulated in JIS Z 2241:2011. The stroke speed of each tension test is set to 2 mm/min until the nominal strain reaches 2% and then is changed to 20 mm/min at the point in time when the nominal strain has reached 2%. In addition, the test force and the displacement of the tension tester are sampled at a rate of 1 sample/second or more.

Next, true stress σ (2.9) and true strain ε (2.9) at a nominal strain of 2.9%, and true stress σ (3.1) and true strain ε (3.1) at a nominal strain of 3.1%, are calculated based on equation (2) and equation (3) below.

$$\sigma(i)=(F(i)/S_0)\times[(L_e(i)+\Delta L(i))/L_e(i)] \tag{2}$$

$$\varepsilon(i)=\ln[(L_e(i)+\Delta L(i))/L_e(i)-F(i)/S_0\times m_\varepsilon] \tag{3}$$

The symbols in equation (2) and equation (3) above are defined below.

σ(i): true stress at nominal strain i %

ε(i): true strain at nominal strain i %

F(i): test force at nominal strain i %

$S_0$: original cross-sectional area of parallel portion of test piece $L_e(i)$: extensometer gauge length at nominal strain i %

ΔL(i): instantaneous value of extensometer elongation at nominal strain i %

$m_\varepsilon$: slope of stress/elongation curve in elastic region

The value of the strain hardening exponent n at a nominal strain of 3% can be calculated by substituting, in equation (4) below, true stress σ (2.9) and a true strain ε (2.9) at a nominal strain of 2.9%, and true stress σ (3.1) and true strain ε (3.1) at a nominal strain of 3.1%.

$$n=\{\ln(\sigma(3.1))-\ln(\sigma(2.9))\}/\{\ln(\varepsilon(3.1))-\ln(\varepsilon(2.9))\} \tag{4}$$

Mechanical Properties

The elongation (elongation at break or elongation at ultimate failure) of aluminum-alloy sheets according to the present teachings is 23% or higher. Because such aluminum-alloy sheets possess an elongation in the above-mentioned specific range, they excel in press formability (plastic deformation). In addition, the 0.2% yield strength of the aluminum-alloy sheets is preferably 100 MPa or higher. In this case, it becomes easy to increase the strength of the final product after the aluminum-alloy sheet has been subjected to plastic deformation.

In addition, the difference TS−YS (i.e. the difference between the tensile strength TS and the 0.2% yield strength YS of the aluminum-alloy sheet) is preferably 120 MPa or higher. In this case, deformability during deep drawing can be further improved.

The tensile strength, the 0.2% yield strength, and the elongation of the aluminum-alloy sheet described above are, specifically, each the average value of the particular property value in three directions, as calculated by equations (5)-(7) below.

$$TS_{ave}=(TS_0+2\times TS_{45}+TS_{90})/4 \tag{5}$$

$$YS_{ave}=(YS_0+2\times YS_{45}+YS_{90})/4 \tag{6}$$

$$EL_{ave}=(EL_0+2\times EL_{45}+EL_{90})/4 \tag{7}$$

In the equations above, symbol $TS_{ave}$ indicates the average value of the tensile strengths in three directions, symbol $TS_0$ indicates the tensile strength in a direction parallel to the rolling direction, symbol $TS_{45}$ indicates the tensile strength in a direction tilted 45° relative to the rolling direction, and symbol $TS_{90}$ indicates the tensile strength in a direction at a right angle to the rolling direction. In addition, in the equations above, symbol $YS_{ave}$ indicates the average value of the 0.2% yield strengths in three directions, symbol $YS_0$ indicates the 0.2% yield strength in the direction parallel to the rolling direction, symbol $YS_{45}$ indicates the 0.2% yield strength in the direction tilted 45° relative to the rolling direction, and symbol $YS_{90}$ indicates the 0.2% yield strength in the direction at a right angle to the rolling direction. In addition, in the equations above, symbol $EL_{ave}$ indicates the average value of the elongations in three directions, symbol $EL_0$ indicates the elongation in the direction parallel to the rolling direction, symbol $EL_{45}$ indicates the elongation in the direction tilted 45° relative to the rolling direction, and symbol $EL_{90}$ indicates the elongation in the direction at a right angle to the rolling direction.

Thickness

The thickness of the aluminum-alloy sheet is not particularly limited and can be set appropriately in accordance with the application of the present teachings. For example, if the aluminum-alloy sheet is used as a blank (raw material) of an automobile body panel, a body sheet, or the like (i.e. a three-dimensionally shaped final product), the thickness of the aluminum-alloy sheet can be set as appropriate within the range of, e.g., 0.8-2.5 mm.

Manufacturing Method of Aluminum-Alloy Sheet

Next, methods for manufacturing aluminum-alloy sheets according to the present teachings will be explained. For example, a representative manufacturing method may include preparing an ingot having a chemical composition that falls within the above-mentioned specific ranges, hot rolling the ingot, cold rolling the sheet formed by hot rolling, and subsequently performing a solution heat treatment on the cold-rolled sheet.

Preparation of Ingot

In such a manufacturing method, the method for preparing the ingot is not particularly limited. For example, an ingot having the above-mentioned specific chemical composition can be manufactured by any suitable melting method such as a continuous casting method, a semi-continuous casting method, or the like.

In such a manufacturing method, for example, aluminum metal, aluminum scrap, or the like can be used as the source of aluminum for the casting material. Examples of scrap that can be used in the casting material include: mill ends removed as unnecessary portions in the process of manufacturing aluminum products; and waste materials of automobile parts, such as body sheets, body panels, fins, tubes, and header tanks of heat exchangers, and the like. To further reduce the materials cost of the aluminum-alloy sheet, the percentage of the casting material that consists of aluminum scrap is preferably 50 mass % or more, more preferably 75 mass % or more, and may even be 100 mass % (i.e. the entire source of aluminum in the casting material is aluminum scrap).

Homogenizing Treatment

After the ingot has been prepared and prior to performing hot rolling, a homogenizing treatment optionally may be performed by heating the ingot if needed. During the homogenizing treatment, the heating temperature is preferably 480° C. or higher and 560° C. or lower, and the hold time is preferably 0.5 h or more and 24 h or less. In this case, elements, such as Si, Mn, and Mg, can sufficiently form a solid solution in the Al matrix, the press formability of the aluminum-alloy sheet ultimately obtained can be improved, and the amount of increase in strength generated by work hardening can be increased.

If the heating temperature during the homogenizing treatment is below 480° C. and/or if the hold time is less than 0.5 h, there is a risk that the effects produced by the homogenizing treatment will become insufficient. If the heating temperature during the homogenizing treatment exceeds 560° C., there is a risk that the ingot will melt. If the hold time during the homogenizing treatment exceeds 24 h, there is a risk that it will lead to a decrease in production efficiency.

If the homogenizing treatment is performed, the ingot after homogenization has completed is preferably cooled such that the average cooling rate is 20° C./h or higher until the temperature of the ingot reaches 300° C. Thus, by rapidly cooling the ingot after the homogenizing treatment, it is possible to suppress an increase in the coarseness of the $Mg_2Si$, the elemental Si, and the like within the ingot. Thereby, it is possible to suppress a decrease in the amounts of Si and Mn in solid solution.

It is noted that, to increase production efficiency, it is preferable to hot roll the ingot without performing the homogenizing treatment.

Hot Rolling

Next, a hot-rolled sheet is manufactured by hot rolling the ingot. In the course of the hot rolling, rollability can be improved by heating the ingot in advance. The heating temperature of the ingot prior to hot rolling can be set as appropriate within the range of, for example, 300° C. or higher and 550° C. or lower. In addition, the hold time during heating of the ingot prior to hot rolling can be set as appropriate within the range of, for example, 0.5 h or more and 24 h or less.

If the heating temperature of the ingot is below 300° C. and/or if the hold time is less than 0.5 h, deformation resistance of the ingot will become large, and consequently there is a risk that it will lead to a decrease in rollability and a decrease in production efficiency. If the heating temperature of the ingot exceeds 550° C., then there is a risk that the temperature of the ingot during hot rolling will exceed the melting point, leading to the generation of cracks during hot rolling. In addition, if the hold time when heating the ingot exceeds 24 h, there is a risk that it will lead to a decrease in production efficiency.

After the ingot has been prepared, if hot rolling is performed without the performance of the homogenizing treatment, the heating temperature during heating prior to hot rolling is preferably set to 500° C. or higher and 550° C. or lower, and the hold time is preferably set to 0.5 h or more and 24 h or less. In this case, Si, Mn, Mg, and the like form a solid solution in the Al matrix owing to the heating prior to hot rolling, and thereby the amounts of solutes of these elements can be made large. As a result, the press formability of the aluminum-alloy sheet ultimately obtained can be improved, and the amount of increase in strength generated by work hardening can be made large.

To further enhance these effects, the heating temperature during heating prior to hot rolling is preferably set to 510° C. or higher and 550° C. or lower. In addition, from the same viewpoint, the hold time during heating prior to hot rolling is preferably set to 2.0 h or more and 24 h or less.

From the viewpoint of production efficiency, the temperature of the hot-rolled sheet when hot rolling has completed can be set to, for example, within the range of 200° C. or higher and 350° C. or lower.

Cold Rolling

The cold-rolled sheet is manufactured by cold rolling the sheet that was obtained by hot rolling. The total rolling reduction of the cold rolling, i.e., the ratio of the difference between the hot-rolled sheet thickness and the cold-rolled sheet thickness with respect to the hot-rolled sheet thickness, is preferably 50% or more and preferably 66% or more. By making the total rolling reduction of the cold rolling high, second-phase particles, such as intermetallic compounds, can be crushed and made fine during cold rolling. Thereby, a decrease in elongation or a degradation in press formability, which are caused by coarse second-phase particles, can be curtailed.

It is noted that, in the manufacturing method, a heat treatment, such as annealing, can also be performed as needed prior to the start of cold rolling, during the cold rolling, or the like.

Solution Heat Treatment

In the solution heat treatment, after the cold-rolled sheet has been heated to the solution-treatment temperature or higher, quenching is performed on the cold-rolled sheet. By performing the solution heat treatment, the aluminum-alloy sheet can be made into a supersaturated solid solution of Si or the like, and the amounts of Si, Mn, etc. in solid solution, can be made sufficiently large.

The heating temperature during the solution heat treatment is preferably 480° C. or higher and 560° C. or lower, more preferably 500° C. or higher and 550° C. or lower, and yet more preferably 520° C. or higher and 550° C. or lower. By setting the heating temperature during the solution heat treatment to the above-mentioned specific ranges, the amounts of solutes of elements, such as Si, that form a solid solution in the Al matrix can be made even larger. As a result, the amounts of solutes of elements, such as Si, in the aluminum-alloy sheet can be made even larger.

If the heating temperature during the solution heat treatment is below 480° C., there is a risk that elements, such as Si, will not sufficiently form a solid solution in the Al matrix, leading to a decrease in the amounts of solutes of elements, such as Si, in the aluminum-alloy sheet. Consequently, in this case, there is a risk of a reduction of the amount of increase in strength generated by plastic working. If the heating temperature during the solution heat treatment exceeds 560° C., there is a risk that the cold-rolled sheet will melt during the solution heat treatment.

In the solution heat treatment, the heating may be terminated immediately after the temperature of the cold-rolled sheet has reached the above-mentioned heating temperature, or this temperature may be held for a fixed time after the heating temperature has been reached. To increase production efficiency, the hold time is preferably set to 5 min or less and more preferably set to 1 min or less.

The cold-rolled sheet is quenched immediately after the above-described heating has completed. The quenching method is not particularly limited, and various cooling methods can be used, such as, for example, forced cooling using a fan, water quenching, or the like. During quenching, cooling is preferably performed such that the average cooling rate is 100° C./min or higher from the temperature at the completion heating until 150° C. is reached, and cooling is more preferably performed such that the average cooling rate is 300° C./min or higher. Thus, by rapidly cooling the cold-rolled sheet after completion of the heating, the amounts of solutes of elements, such as Si, that form a solid solution in the Al matrix can be made even larger. As a result, the amounts of solutes of elements, such as Si, in the aluminum-alloy sheet can be made even larger. It is noted that the upper-limit value of the average cooling rate is determined by the apparatus used for quenching, the quenching method, and the like. From the viewpoints of productivity and ease of operation, the average cooling rate is preferably 10,000° C./min or lower.

Pre-Aging Treatment

In the above-mentioned manufacturing method, a pre-aging treatment may be performed by heating the aluminum-alloy sheet after the solution heat treatment has been performed. In this case, the aluminum-alloy sheet is hardened after painting and baking, and thereby strength can be further increased. To further enhance these effects, the pre-aging treatment is preferably performed immediately after the solution heat treatment. In addition, from the same viewpoint, in the pre-aging treatment, the heating temperature is more preferably set to 50° C. or higher and 150° C. or lower, and the hold time is more preferably set to 1 h or more and 100 h or less.

WORKING EXAMPLES

Working examples of aluminum-alloy sheets according to the present teachings are explained below. It is noted that specific aspects of aluminum-alloy sheets according to the present teachings are not limited to the aspects of the working examples, and the compositions can be suitably modified within ranges that do not depart from the gist of the present invention.

In the present examples, first, slabs having the chemical compositions (Test Materials A1-A14) listed in Table 1 were manufactured by DC casting. It is noted that Test Material A12 is an A6111 alloy, which is widely used in automobile body sheets, panels, etc.

In addition, the abbreviation "Bal." in Table 1 indicates that the particular component (aluminum) is the residual component (balance). Casting materials used to manufacture the slabs are not particularly limited; for example, aluminum automobile scrap can be used as the source of aluminum in the casting material.

TABLE 1

| Test Material | Chemical Composition (mass %) | | | | | | | | | | |
|---|---|---|---|---|---|---|---|---|---|---|---|
| Symbol | Si | Fe | Cu | Mn | Mg | Cr | Zn | Ti | Ni | Al | Si/Mn |
| A1 | 2.5 | 0.10 | 0.10 | 0.41 | 0.40 | — | 0.01 | 0.01 | 0.01 | Bal. | 6.1 |
| A2 | 2.8 | 0.20 | 0.15 | 0.57 | 0.45 | 0.02 | 0.09 | 0.03 | 0.03 | Bal. | 4.9 |
| A3 | 3.2 | 0.40 | 0.20 | 0.73 | 0.50 | 0.04 | 0.11 | 0.06 | 0.07 | Bal. | 4.4 |
| A4 | 3.5 | 0.30 | 0.30 | 1.00 | 0.56 | 0.01 | 0.48 | 0.09 | — | Bal. | 3.5 |
| A5 | 3.6 | 0.10 | 0.31 | 1.03 | 0.57 | 0.06 | 0.32 | 0.12 | 0.12 | Bal. | 3.5 |
| A6 | 3.6 | 0.30 | 0.31 | 0.72 | 0.54 | 0.06 | 0.32 | 0.12 | 0.11 | Bal. | 5.0 |
| A7 | 3.6 | 0.30 | 0.31 | 0.49 | 0.55 | 0.06 | 0.29 | 0.12 | 0.12 | Bal. | 7.3 |
| A8 | 2.4 | 0.10 | 0.09 | 0.43 | 0.44 | — | 0.01 | 0.01 | — | Bal. | 5.6 |
| A9 | 3.0 | 0.20 | 0.19 | 0.74 | 0.50 | 0.03 | 0.13 | 0.05 | 0.05 | Bal. | 4.1 |
| A10 | 3.6 | 0.30 | 0.31 | 1.03 | 0.56 | 0.06 | 0.33 | 0.12 | 0.12 | Bal. | 3.5 |
| A11 | 2.1 | 0.30 | 0.32 | 1.00 | 0.57 | 0.01 | 0.42 | 0.09 | — | Bal. | 2.1 |
| A12 | 1.0 | 0.10 | 0.70 | 0.05 | 0.44 | 0.04 | 0.01 | 0.01 | — | Bal. | 20.0 |
| A13 | 3.6 | 0.30 | 0.31 | 0.25 | 0.55 | 0.06 | 0.29 | 0.13 | 0.11 | Bal. | 14.4 |
| A14 | 3.5 | 0.50 | 0.50 | 1.00 | 0.80 | 0.05 | 0.50 | 0.10 | — | Bal. | 3.5 |

With regard to Test Materials A1-A11 and Test Materials A13-A14, the slabs obtained by DC casting were hot rolled without being subjected to a homogenizing treatment. Subsequently, cold rolling and solution heat treatment were performed sequentially. In the solution heat treatment, heating was terminated at the point in time when the temperature of the cold-rolled sheet reached the desired temperature, after which quenching was performed immediately. The average cooling rate during the quenching, that is, the average cooling rate from the temperature at the heating-end time until 150° C. was reached, was set to 600° C./min or higher and 1,000° C. min or lower. After the solution heat treatment was completed, a pre-aging treatment was performed immediately on the aluminum-alloy sheet. In the pre-aging treatment, the heating temperature was set to 70° C. or higher and 80° C. or lower, and the hold time was set to 5 h.

In addition, with regard to Test Material A12, a homogenizing treatment and hot rolling were performed sequentially on the slab, which had been obtained by DC casting. Subsequently, multiple cold-rolling passes were performed on the hot-rolled sheet. At this time, intermediate annealing was performed by heating the cold-rolled sheet to 550° C. between each of the cold-rolling passes. After the final pass of cold rolling was completed, a solution heat treatment was performed on the cold-rolled sheet. In the solution heat treatment, heating was terminated at the point in time when the temperature of the cold-rolled sheet reached the desired temperature, after which quenching was performed immediately. The average cooling rate during the quenching, that is, the average cooling rate from the temperature at the heating-end time until 150° C. was reached, was set to 600° C./min or higher and 1,000° C./min or lower. After the solution heat treatment was completed, a pre-aging treatment was performed on the aluminum-alloy sheet immediately. In the pre-aging treatment, the heating temperature was set to 70° C. or higher and 80° C. or lower, and the hold time was set to 5 h.

Thus, the aluminum-alloy sheets (Test Materials A1-A14) were manufactured according to the processing steps explained above. Combinations of the heating temperature during the homogenizing treatment, the heating temperature of the slab prior to hot rolling, the temperature of the hot-rolled sheet when hot rolling was completed, the total rolling reduction of the cold rolling, the thickness of the cold-rolled sheet, and the furnace type and heating temperature used in the solution heat treatment, are shown in Table 2. In addition, the manufacturing conditions used for each test material are shown in Table 3.

Next, the tensile strengths, the work-hardening properties, and the corrosion-resistance evaluation methods of Test Materials A1-A14 will be explained.

Mechanical Properties

A test piece No. 5, as stipulated in JIS Z 2241:2011, was taken (cut, excised) from each test material such that the longitudinal direction and the rolling direction were parallel to one another. For each test piece, a tension test was performed using a method that complied with JIS Z 2241:2011, and thereby the tensile strength, the 0.2% yield strength, and the elongation in the direction parallel to the rolling direction were calculated.

In addition, a test piece No. 5, in which the angle formed by the longitudinal direction and the rolling direction was 45°, and a test piece, in which the longitudinal direction was at a right angle to the rolling direction, were taken (cut, excised) from each test material, and the tensile strength, the 0.2% yield strength, and the elongation in the direction tilted by 45° relative to the rolling direction and in the direction at a right angle to the rolling direction were calculated by performing the tension test, which used a method that complied with JIS Z 2241:2011, the same as mentioned above.

Using the tensile strengths, 0.2% yield strengths, and elongations in the directions obtained as described above, the average values of the tensile strength, the 0.2% yield strength, and the elongation in three directions were calculated by using equations (5)-(7) below.

$$TS_{ave}=(TS_0+2\times TS_{45}+TS_{90})/4 \quad (5)$$

$$YS_{ave}=(YS_0+2\times YS_{45}+YS_{90})/4 \quad (6)$$

$$EL_{ave}=(EL_0+2\times EL_{45}+EL_{90})/4 \quad (7)$$

It is noted that, in the equations above, symbol $TS_{ave}$ indicates the average value of the tensile strengths in three directions, symbol $TS_0$ indicates the tensile strength in a direction parallel to the rolling direction, symbol $TS_{45}$ indicates the tensile strength in a direction tilted 45° relative to the rolling direction, and symbol $TS_{90}$ indicates the tensile strength in a direction at a right angle to the rolling direction. In addition, in the equations above, symbol $YS_{ave}$ indicates the average value of the 0.2% yield strengths in three directions, symbol $YS_0$ indicates the 0.2% yield strength in the direction parallel to the rolling direction, symbol $YS_{45}$ indicates the 0.2% yield strength in the direction tilted 45° relative to the rolling direction, and symbol $YS_{90}$ indicates the 0.2% yield strength in the direction at a right angle to the rolling direction. In addition, in the equations above, symbol $EL_{ave}$ indicates the average value of the elongations in three directions, symbol $EL_0$ indicates the elongation in the direction parallel to the rolling direction, symbol $EL_{45}$ indicates the elongation in the direction tilted 45° relative to the rolling direction, and symbol $EL_{90}$ indicates the elongation in the direction at a right angle to the rolling direction.

The average values of the tensile strengths, 0.2% yield strengths, and elongations in three directions are shown in Table 3.

Work-Hardening Properties

A test piece No. 5, as stipulated in JIS Z 2241:2011, was taken (cut, excised) from each test material such that the longitudinal direction and the rolling direction were parallel to one another. Using these test pieces, the strain hardening exponent of each test material was calculated using the method described above. The strain hardening exponents are shown in Table 3.

Corrosion Resistance

An intergranular-corrosion test was performed using a method that complied with method B stipulated in ISO 11846. Specifically, a test piece having an oblong shape in which the length was 20 mm and the width was 50 mm was taken (cut, excised) from each test material. Each test piece was cleaned using nitric acid and subsequently rinsed with distilled water. Subsequently, the test pieces were immersed for 20 h in an aqueous solution having an NaCl concentration of 30 g/L and an HCl concentration of 10 ml/L at a temperature of 20° C.

The test pieces removed from the aqueous solution were cleaned with nitric acid and subsequently rinsed with distilled water. Subsequently, cross sections of the test pieces parallel to the rolling direction were observed, and the intergranular-corrosion depths were measured. The "Maximum Intergranular-Corrosion Depth" column in Table 3 indicates the maximum value of the intergranular-corrosion depth in the observed cross section. It is noted that symbol "?" was recorded in the "Maximum Intergranular-Corrosion Depth" column for test materials for which the intergranular-corrosion test was not performed.

TABLE 2

| Manufacturing Condition Symbol | Homogenizing Treatment: Holding Temperature (° C.) | Hot Rolling: Heating Temperature (° C.) | Hot Rolling: Temperature at Completion (° C.) | Cold Rolling: Total Rolling Reduction (%) | Cold Rolling: Intermediate Annealing | Cold Rolling: Thickness after Cold Rolling (mm) | Solution Heat Treatment: Furnace Type | Solution Heat Treatment: Heating Temperature (° C.) |
|---|---|---|---|---|---|---|---|---|
| C1 | — | 525 | 310 | 75 | — | 0.9 | Continuous annealing furnace | 540 |
| C2 | — | 525 | 310 | 58 | — | 2.5 | Continuous annealing furnace | 540 |
| C3 | — | 540 | 250 | 83 | — | 1.0 | Salt bath furnace | 540 |
| C4 | — | 540 | 250 | 83 | — | 1.0 | Salt bath furnace | 520 |
| C5 | — | 525 | 310 | 67 | — | 1.2 | Continuous annealing furnace | 540 |
| C6 | 540 | 400 | 230 | 75 | Yes | 1.0 | Continuous annealing furnace | 550 |
| C7 | — | 540 | 250 | 67 | — | 2.0 | Salt bath furnace | 540 |

TABLE 3

| Test Material Symbol | Manufacturing Condition Symbol | Tensile Strength (MPa) | 0.2% Yield Strength (MPa) | Elongation (%) | Strain Hardening Exponent | Maximum Intergranular-Corrosion Depth (μm) |
|---|---|---|---|---|---|---|
| A1 | C1 | 234 | 113 | 27 | 0.30 | 100 |
| A2 | C1 | 250 | 124 | 25 | 0.29 | 120 |
| A3 | C1 | 259 | 129 | 24 | 0.29 | 150 |
| A4 | C2 | 261 | 131 | 24 | 0.28 | 190 |
| A5 | C3 | 285 | 136 | 23 | 0.29 | — |
| A6 | C3 | 284 | 136 | 23 | 0.29 | — |
| A7 | C3 | 282 | 134 | 24 | 0.29 | — |
| A8 | C3 | 254 | 121 | 26 | 0.28 | — |
| A9 | C4 | 257 | 118 | 23 | 0.31 | — |
| A10 | C3 | 283 | 136 | 24 | 0.29 | — |
| A11 | C5 | 261 | 142 | 26 | 0.24 | 190 |
| A12 | C6 | 250 | 124 | 31 | 0.27 | 210 |
| A13 | C3 | 277 | 138 | 25 | 0.27 | — |
| A14 | C7 | 266 | 125 | 22 | 0.30 | — |

As shown in Table 1 and Table 3, Test Materials A1-A10 have the above-mentioned specific chemical compositions. Consequently, the strain hardening exponents at a nominal strain of 3% could be set in the above-mentioned specific range. Furthermore, with regard to Test Materials A1-A10, because the strain hardening exponents at a nominal strain of 3% were in the above-mentioned specific range, the amount of increase in strength generated by work hardening, even in plastic working such as press forming in which the magnitude of the introduced strain is comparatively small, could be made relatively large.

In addition, it is noted that Test Materials A1-A3, Test Materials A5-A7, and Test Materials A9-A10 contain Ni, which enabled the strain hardening exponents to be made even larger than the test materials that did not contain Ni. More specifically, each of Test Materials A1-A3, Test Materials A5-A7, and Test Materials A9-A10 exhibited a strain hardening coefficient of 0.29 or more. Furthermore, with regard to Test Materials A1-A3, the maximum intergranular-corrosion depths could be made shallower and corrosion resistance could be increased compared with the test materials that did not contain Ni.

The Si content and the Si/Mn value of Test Material A11 were outside the above-mentioned specific ranges. Consequently, the strain hardening exponent of Test Material A11 was smaller (less) than the strain hardening exponents of Test Materials A1-A10.

The Si content, the Mn content, and the Si/Mn value of Test Material A12 were outside the above-mentioned specific ranges. Consequently, the strain hardening exponent of Test Material A12 was smaller (less) than the strain hardening exponents of Test Materials A1-A10.

The Mn content and the Si/Mn value of Test Material A13 were outside the above-mentioned specific ranges. Consequently, the strain hardening exponent of Test Material A13 was smaller (less) than the strain hardening exponents of Test Materials A1-A10.

The Fe content and the Mg content of Test Material A14 were outside the above-mentioned specific ranges. Consequently, the elongation of Test Material A14 was smaller (less) than the elongations of Test Materials A1-A10.

We claim:

1. An aluminum-alloy sheet comprising:

Si: 2.3-3.8 mass %,

Mn: 0.35-1.05 mass %,

Mg: 0.35-0.65 mass %,

Fe: 0.01-0.45 mass %, and at least one element selected from the group consisting of Cu: 0.0010-1.0 mass %, Cr: 0.0010-0.10 mass %, Zn: 0.0010-0.50 mass %, and Ti: 0.0050-0.20 mass %, wherein the aluminum-alloy sheet has an Si/Mn mass ratio of 3.0-9.0, an elongation of at least 23%, and a strain hardening exponent of at least 0.28 at a nominal strain of 3%.

2. The aluminum-alloy sheet according to claim 1, wherein the aluminum-alloy sheet further contains Ni: 0.0050-0.15 mass %.

3. The aluminum-alloy sheet according to claim 2, wherein the strain hardening exponent is at least 0.29 at a nominal strain of 3%.

4. The aluminum-alloy sheet according to claim 3, wherein the aluminum-alloy sheet has a Cu content of 0.0010-0.20 mass %.

5. The aluminum-alloy sheet according to claim 3, wherein the aluminum-alloy sheet has a Cu content of 0.10-0.20 mass %.

6. The aluminum-alloy sheet according to claim 1, wherein the aluminum-alloy sheet contains at least two elements selected from the group consisting of Cu: 0.0010-1.0 mass %, Cr: 0.0010-0.10 mass %, Zn: 0.0010-0.50 mass %, and Ti: 0.0050-0.20 mass %.

7. The aluminum-alloy sheet according to claim 6, wherein the aluminum-alloy sheet further contains Ni: 0.0050-0.15 mass %.

8. The aluminum-alloy sheet according to claim 1, wherein the aluminum-alloy sheet contains Cu: 0.0010-1.0 mass %, Cr: 0.0010-0.10 mass %, Zn: 0.0010-0.50 mass %, and Ti: 0.0050-0.20 mass %.

9. The aluminum-alloy sheet according to claim 1, wherein the aluminum-alloy sheet has an Si content of 2.4-3.6 mass %.

10. The aluminum-alloy sheet according to claim 1, wherein the aluminum-alloy sheet has an Mn content of 0.4-1.05 mass %.

11. The aluminum-alloy sheet according to claim 1, wherein the Si/Mn mass ratio is 3.0-8.0.

12. The aluminum-alloy sheet according to claim 1, wherein the aluminum-alloy sheet has an Mg content of 0.4-0.6 mass %.

13. The aluminum-alloy sheet according to claim 1, wherein the aluminum-alloy sheet has an Fe content of 0.1-0.4 mass %.

14. The aluminum-alloy sheet according to claim 1, wherein the aluminum-alloy sheet has a thickness of 0.8-2.5 mm.

15. An aluminum-alloy sheet comprising:

Si: 2.3-3.8 mass %,

Mn: 0.35-1.05 mass %,

Mg: 0.35-0.65 mass %,

Fe: 0.01-0.45 mass %, and at least one element selected from the group consisting of Cu: 0.0010-1.0 mass %, Cr: 0.0010-0.10 mass %, Zn: 0.0010-0.50 mass %, and Ti: 0.0050-0.20 mass %, wherein the aluminum-alloy sheet has an Si/Mn mass ratio of 2.5-9.0, an elongation of at least 23%, and a strain hardening exponent of at least 0.28 at a nominal strain of 3%, and the aluminum-alloy sheet is an automobile body panel.

16. The aluminum-alloy sheet according to claim 15, wherein:

the automobile body panel is a three-dimensionally shaped product having a thickness of 0.8-2.5 mm; and the Si/Mn mass ratio is 3.0-9.0.

17. A method for manufacturing the aluminum-alloy sheet according to claim 1, comprising:

providing an aluminum alloy material that contains Si: 2.3-3.8 mass %, Mn: 0.35-1.05 mass %, Mg: 0.35-0.65 mass %, Fe: 0.01-0.45 mass %, and at least one element selected from the group consisting of Cu: 0.0010-1.0 mass %, Cr: 0.0010-0.10 mass %, Zn: 0.0010-0.50 mass %, and Ti: 0.0050-0.20 mass %, the aluminum alloy material having an Si/Mn mass ratio of 2.5-9.0;

hot rolling the aluminum-alloy material to form a sheet, the aluminum-alloy material being heated to 300-550° C. prior to hot-rolling and the hot-rolled sheet being at a temperature of 200-350° C. at the end of the hot rolling;

cold rolling the sheet formed by the hot rolling such that a total rolling reduction of the cold rolling is at least 50%;

subjecting the sheet formed by the cold rolling to a solution heat treatment in a temperature range of 480-560° C. and quenching at a cooling rate of at least 100° C./min until the sheet reaches 150° C.; and after the solution heat treatment, subjecting the sheet to a pre-aging treatment in a temperature range of 50-150° C. for 1-100 hours;

wherein after the pre-aging, the aluminum alloy sheet exhibits an elongation of at least 23% and a strain hardening exponent of at least 0.28 at a nominal strain of 3%.

18. The method according to claim 17, further comprising press forming the aluminum alloy sheet to form an automobile body panel.

19. An aluminum-alloy sheet produced by a process comprising:

providing an aluminum alloy material that contains Si: 2.3-3.8 mass %, Mn: 0.35-1.05 mass %, Mg: 0.35-0.65 mass %, Fe: 0.01-0.45 mass %, and at least one element selected from the group consisting of Cu: 0.0010-1.0 mass %, Cr: 0.0010-0.10 mass %, Zn: 0.0010-0.50 mass %, and Ti: 0.0050-0.20 mass %, the aluminum alloy material having an Si/Mn mass ratio of 3.0-9.0;

hot rolling the aluminum-alloy material to form a sheet, the aluminum-alloy material being heated to 300-550° C. prior to hot-rolling and the hot-rolled sheet being at a temperature of 200-350° C. at the end of the hot rolling;

cold rolling the sheet formed by the hot rolling such that a total rolling reduction of the cold rolling is at least 50%;

subjecting the sheet formed by the cold rolling to a solution heat treatment in a temperature range of 480-560° C. and quenching at a cooling rate of at least 100° C./min until the sheet reaches 150° C.; and after the solution heat treatment, subjecting the sheet to a pre-aging treatment in a temperature range of 50-150° C. for 1-100 hours;

wherein after the pre-aging, the aluminum alloy sheet exhibits an elongation of at least 23% and a strain hardening exponent of at least 0.28 at a nominal strain of 3%.

20. The aluminum-alloy sheet according to claim 19, wherein the aluminum-alloy sheet contains at least two elements selected from the group consisting of Cu: 0.0010-1.0 mass %, Cr: 0.0010-0.10 mass %, Zn: 0.0010-0.50 mass %, and Ti: 0.0050-0.20 mass %.

21. The aluminum-alloy sheet according to claim 20, wherein the aluminum-alloy sheet further contains Ni: 0.0050-0.15 mass %.

22. The aluminum-alloy sheet according to claim 21, wherein:

the aluminum-alloy sheet has a Cu content of 0.0010-0.20 mass %, an Si content of 2.4-3.3 mass %, an Mn content of 0.4-0.8 mass %, an Mg content of 0.4-0.6 mass %, and an Fe content of 0.1-0.4 mass %, the Si/Mn mass ratio is 4.0-6.5;

the aluminum-alloy material is heated to 500-550° C. prior to the hot-rolling, the hot-rolled sheet being at a temperature of 280-350° C. at the end of the hot rolling;

the total rolling reduction of the cold rolling is at least 70%;

the solution heat treatment performed in a temperature range of 510-560° C.;

the strain hardening exponent after pre-aging is at least 0.29 at a nominal strain of 3%; and the aluminum-alloy sheet is an automobile body panel.

23. The aluminum-alloy sheet according to claim 22, wherein:

after the cold rolling, the aluminum-alloy sheet has a thickness of 0.8-2.5 mm; and the aluminum-alloy sheet has been stamped into the form of a three-dimensionally shaped automobile body panel.

24. An automobile body panel produced by a process comprising:

stamping the aluminum-alloy sheet of claim 19, to form a three-dimensionally shaped final product.

* * * * *